US006186215B1

(12) United States Patent
DeYoung et al.

(10) Patent No.: US 6,186,215 B1
(45) Date of Patent: Feb. 13, 2001

(54) MULTI-POSITIONAL ROLLING WINDOW SCREEN

(75) Inventors: Daniel L. DeYoung, Woodstock; Gary R. Harden, Acworth, both of GA (US)

(73) Assignee: Window Bright Corporation, Woodstock, GA (US)

( * ) Notice: Under 35 U.S.C. 154(b), the term of this patent shall be extended for 0 days.

(21) Appl. No.: 09/277,490

(22) Filed: Mar. 26, 1999

(51) Int. Cl.[7] ..... A47G 5/02

(52) U.S. Cl. ..... 160/290.1; 160/265; 160/100; 160/28

(58) Field of Search ..... 160/290.1, 27, 160/28, 100, 267.1, 265, 271, 23.1, 319, 320

(56) References Cited

U.S. PATENT DOCUMENTS

| | | | | |
|---|---|---|---|---|
| 1,521,155 | * | 12/1924 | Isaacs | 160/265 |
| 1,583,133 | | 5/1926 | Fierman . | |
| 1,974,645 | * | 9/1934 | Dixson | 160/290.1 X |
| 2,261,443 | | 11/1941 | McGaw . | |
| 2,302,638 | | 11/1942 | Messina . | |
| 2,352,609 | * | 7/1944 | Bates | 160/290.1 X |
| 2,368,770 | * | 2/1945 | Norden | 160/100 X |
| 2,432,808 | | 12/1947 | Royak . | |
| 2,615,512 | | 10/1952 | Friis . | |
| 4,258,517 | * | 3/1981 | Hammond | 160/290.1 X |
| 4,399,855 | * | 8/1983 | Volfson | 160/290.1 X |
| 4,658,879 | | 4/1987 | Van Klompenburg . | |
| 4,702,297 | | 10/1987 | Van Klompenburg . | |
| 4,781,235 | | 11/1988 | Hedstrom et al. . | |
| 4,993,468 | | 2/1991 | Hackman et al. . | |
| 5,092,388 | | 3/1992 | Evers . | |
| 5,771,952 | * | 6/1998 | Gabriel | 160/265 X |

* cited by examiner

*Primary Examiner*—David M. Purol
(74) *Attorney, Agent, or Firm*—Troutman Sanders LLP; R. Stevan Coursey

(57) ABSTRACT

A rolling window screen assembly for use with a window assembly. The screen assembly is deployable in at least three positions. The first engagement position exists wherein the flexible screen may be extended over the entire window. The second engagement position exists wherein the flexible screen is releasably engaged to a sash to enable the flexible screen o be deployed dynamically according to the position of the sash. Finally, the flexible screen may be disengaged from the window assembly and retracted to expose substantially all of the window opening. A pull-cord apparatus having a pull-down non-elastic cord interfacing with an elastic take-up cord may be utilized for manipulating the flexible screen.

15 Claims, 8 Drawing Sheets

MULTI-POSITIONAL ROLLING WINDOW SCREEN

BACKGROUND OF THE INVENTION

The present invention relates generally to the field of window coverings, and more specifically, to a multi-positional rolling window screen apparatus for selectively covering an open window.

It is well known that many windows may be opened in order to allow air to pass the outside environment into a dwelling. However, an open window also enables small animals and insects to enter a dwelling. Consequently, in order to allow the passage of air without allowing the passage of animals and insects, building owners commonly cover some or all of a window with a window screen.

A common window screen assembly utilizes mesh contained within an aluminum housing sized to fit a window. This screen assembly is affixed to the outside of a window within the window frame and generally stays in place covering the entire window until removed for storage. Installation must be done either through the use of a ladder or by maneuvering each screen through the interior of the building and through the open window. The difficulties involved in the process usually dictate that the screens are installed and removed seasonally at most, or, alternatively, left in place permanently. These screens are bulky and cumbersome and require careful storage preventing the mesh from being damaged.

Additionally, these screen assemblies, when deployed in a window frame, commonly collect dirt or insect matter or deteriorate in harsh weather conditions. The aesthetic appearance of the screens is thus diminished over time. Once installed, framed screens remain deployed at all times whether or not the window is open.

Furthermore, some attempts have been made which employ rolled up screens which are unrolled to cover a window opening. While such screens are useful for their intended purpose, limitations exist which prevent the screens from being used in a more advantageous manner. For instance, some screens are intended to only partially cover a window area or are designed to fully cover the entire window area. However, a need arises to provide a user with the option of positioning the window screens in a manner determined at the time of operation versus the limitations of the screen itself in determining the positioning of the screen.

There is a need, therefore, in the industry for a window screen apparatus for selectively covering an open window for these and other related, and unrelated, purposes.

SUMMARY OF THE INVENTION

Briefly described, the present invention, includes a preferred rolling window screen apparatus for selectively covering a window. The rolling window screen may be deployed in two extended states preventing animals and insects from entering the building through the window when the window sash is open. Since windows generally consist of a top window sash and a bottom window sash, the rolling window screen is designed to cover the area left open by either the top or bottom sash. When the top sash is lowered opening the upper portion of the window, the rolling window screen may be partially deployed in a first extended state covering the upper window portion. When the lower sash is lifted opening the lower portion of the window, the rolling window screen may be fully deployed covering the lower window portion. Alternatively, the rolling window screen may be left in a third, retracted undeployed state. In this state, no obstruction exists for blocking light from entering the building or obstruct the view through the window. Additionally, when in the retracted, undeployed state, the rolling window screen improves the aesthetic appearance of the window in which it is installed by not being seen when not needed.

In one preferred embodiment, the rolling window screen apparatus comprises a take-up roller rotatably attachable between sides of a window frame and adjacent the outer sides of an upper window sash slideably mounted between the sides of the window frame. A flexible screen wraps and unwraps, as required, around the take-up roller during the deployment and retraction of the screen. Preferably, the flexible screen is manufactured from plastic-coated fiberglass filaments woven together to form a mesh. The rolling window screen apparatus also includes a resilient pull-down bar which receives and securely grips a lower edge of the flexible screen. Opposing ends of the pull-down bar ride within vertical slots defined by side channels, which are affixed to opposing sides of the window frame and extend for substantially the height of the window frame. The side channels guide the pull-down bar and the flexible screen during deployment and retraction, thereby limiting movement of the flexible screen to a substantially vertical direction and promoting smooth operation.

The rolling window screen apparatus also comprises a pull-cord apparatus for effecting movement of the flexible screen. The pull-cord apparatus includes the pull-down bar and a pair of cords. A first, non-elastic pull-cord depends from a location on the pull-down bar which is centrally-located between the ends of the pull-down bar. A second, elastic take-up cord has a first end secured to one end of the pull-down bar. The remainder of the elastic take-up cord is guided from the first end of the pull-down bar to the second, opposite end of the pull-down bar. An interface interfaces the non-elastic pull-cord with the elastic take-up cord. The elastic property of the elastic take-up cord causes the second end of the elastic take-up cord to be normally pulled toward the second end of the pull-down bar, and, hence, guides the pull-cord in a direction parallel to the axial direction of the take-up roller and allows the pull-cord cord to depend, in an aesthetically-pleasing manner, adjacent a side of the window frame. When a user exerts a generally downward force on the pull-cord for the purpose of manually deploying the flexible screen, the elastic property of the elastic take-up cord allows the pull-cord to become repositioned centrally beneath the pull-down bar, thereby enabling the downward force of the user to be applied centrally beneath the ends of the pull-down bar. Upon the removal of the downward force, the interface, positioned adjacent the second end of the pull-down bar, allows the pull-cord to depend adjacent a side of the window frame.

The rolling window apparatus further comprises a first automatic deployment interface which is suitable for engaging a retention deployment interface mountable on the uppermost segment of the upper window sash. When engaged, should a user slide down the upper sash of the window, the retention deployment interface engages the first automatic deployment interface and exerts a generally downward force on the pull-down bar, thereby causing the flexible screen to automatically deploy from the take-up roller as the upper sash is slideably moved downward by the user and retains the flexible screen in a deployed position covering the window area left open by the lowering of the upper sash.

The rolling window apparatus further comprises a pair of retention members which are mountable to the lowermost segment of the window frame. The retention members engage the first automatic deployment interface retaining the flexible screen in a fully deployed position covering the entire window.

In operation, the flexible screen may be deployed in at least three deployment states. The three deployment states include the following: (i) a first engagement state wherein the flexible screen is releasably engaged to the window frame to enable the flexible screen to be deployed statically to cover at least a portion of the opening; (ii) a second engagement state wherein the flexible screen is releasably engaged to the sash to enable the flexible screen to be deployed dynamically according to the position of the sash; and (iii) a third engagement state wherein the flexible screen is disengaged from the window assembly to enable the retraction of the flexible screen onto the roller to expose substantially all of the opening.

It is therefore an object of the present invention to provide a retractable window screen.

Another object of the present invention is to provide an apparatus for quickly and easily deploying and removing a window screen.

Another object of the present invention is to provide a rolling window screen apparatus which automatically deploys when a window is opened.

Another object of the present invention is to provide a rolling window screen apparatus which may be deployed in at least three engagement states.

Another object of the present invention is to provide a rolling window screen apparatus which is aesthetically pleasing.

Yet another object of the present invention is to provide a rolling window screen apparatus which is easily mountable to a window.

Still another object of the present invention is to provide a rolling window screen apparatus having a pull-cord which is aesthetically pleasing.

Still another object of the present invention is to provide a rolling window screen apparatus having a convenient pull-cord apparatus for easily deploying the screen.

Still another object of the present invention is to provide a pull-cord assembly which may be utilized with other window coverings.

These and other objects, features and advantages of the present invention will become apparent upon reading and understanding this specification, taken in conjunction with the accompanying drawings.

DETAILED DESCRIPTION OF THE PREFERRED EMBODIMENT

Figure 1:
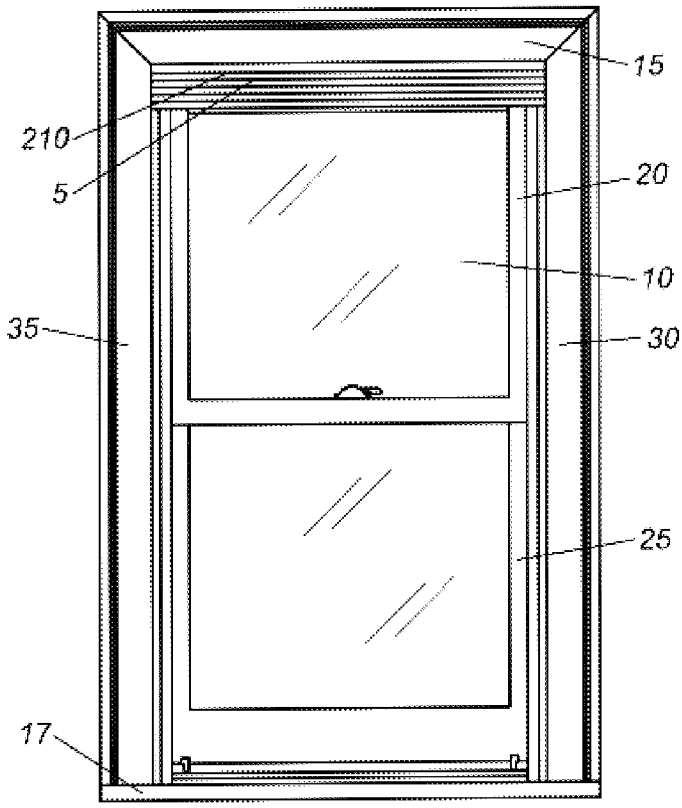
FIG. 1 is a front view of a rolling window screen apparatus, in a typical window environment, in accordance with the preferred embodiments of the present invention.

Referring now to the drawings, in which like numerals represent like components throughout the several views, a rolling window screen assembly 5, in accordance with the first preferred embodiment of the present invention, is shown in FIG. 1. The window screen assembly 5 is positioned within a window assembly 10 for deployment within the window area. The window assembly 10 is shown including a window frame 15, an upper window sash 20 and a lower window sash 25. The window frame 15 includes a pair of sides 30, 35 and a sill 17. The sill 17 is located substantially at the lower ends of the sides 30, 35 and connects the pair of sides 30, 35 together. The upper window sash 20 and the lower window sash 25 are slideably mounted between the window frame sides 30, 35. The upper window sash 20 and the lower window sash 25 are conventionally operable to be lowered and raised, respectively, in order to open the window.

Figure 2:
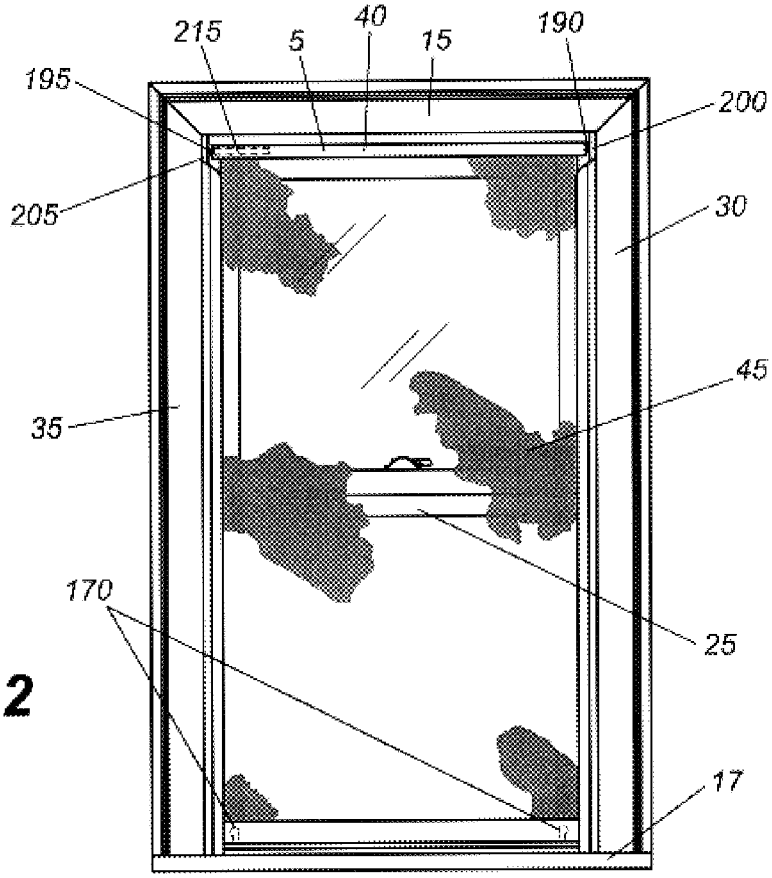
FIG. 2 is a front view of the rolling window screen apparatus of FIG. 1 with the front wall member removed, in which the screen is in a fully deployed position.

As shown in FIG. 2, the rolling window screen assembly includes a flexible screen 45 which may be deployed from the top of the window frame to the bottom of the window frame to fully cover the window area. In this position, should the lower window sash 25 be opened, flexible screen 45 will cover the window opening.

Figure 3:
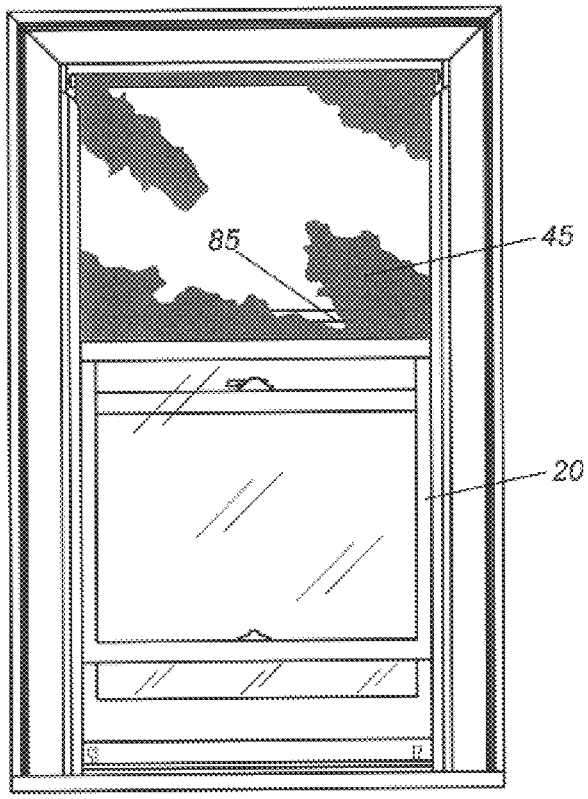
FIG. 3 is a front view of a rolling window screen apparatus of FIG. 2 in which the screen is in a partial deployment facilitated by the positioning of the upper sash

As shown in FIG. 3, flexible screen 45 may be partially deployed to cover a window opening created by the lowering of the upper sash. In this manner, flexible screen 45 is releasably attached to the upper sash and automatically lowered covering the window opening when the upper sash is lowered.

Figure 4:
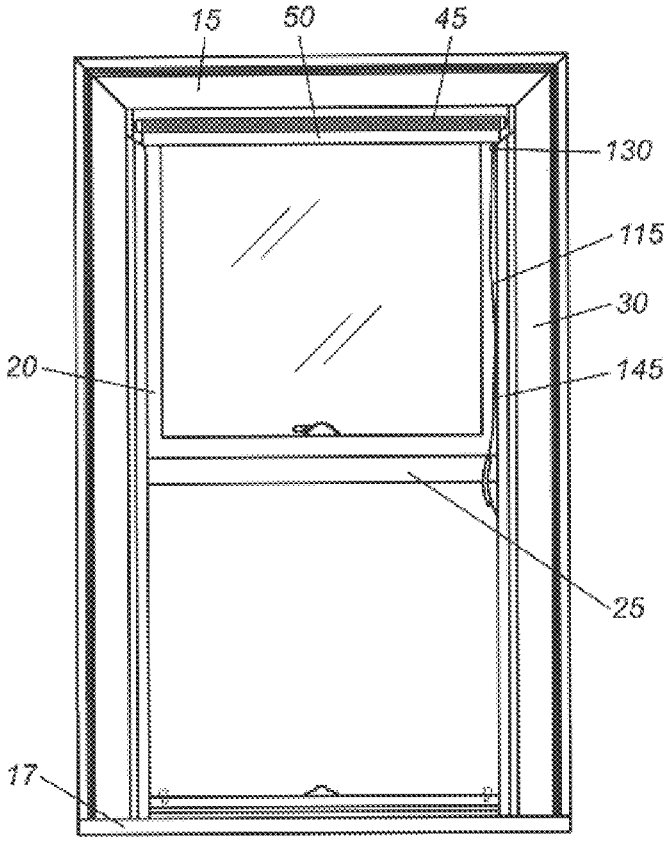
FIG. 4 is a front view of the rolling window screen apparatus of FIG. 1 with the front wall member removed, in which the lower window sash is raised.

As shown in FIG. 4, flexible screen 45 may be maintained in an undeployed state leaving a window opening open and unrestricted.

Figure 5:
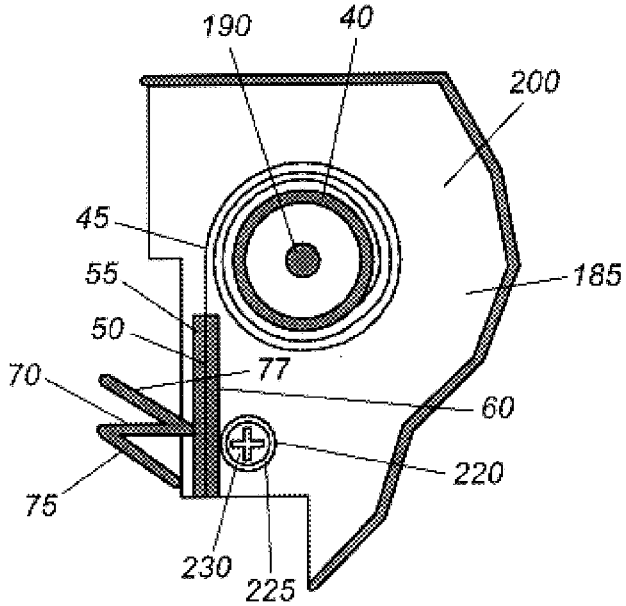
FIG. 5 is a detailed cross-sectional view of the roller, screen and housing of the rolling window screen apparatus of FIG. 4.
Figure 6A:
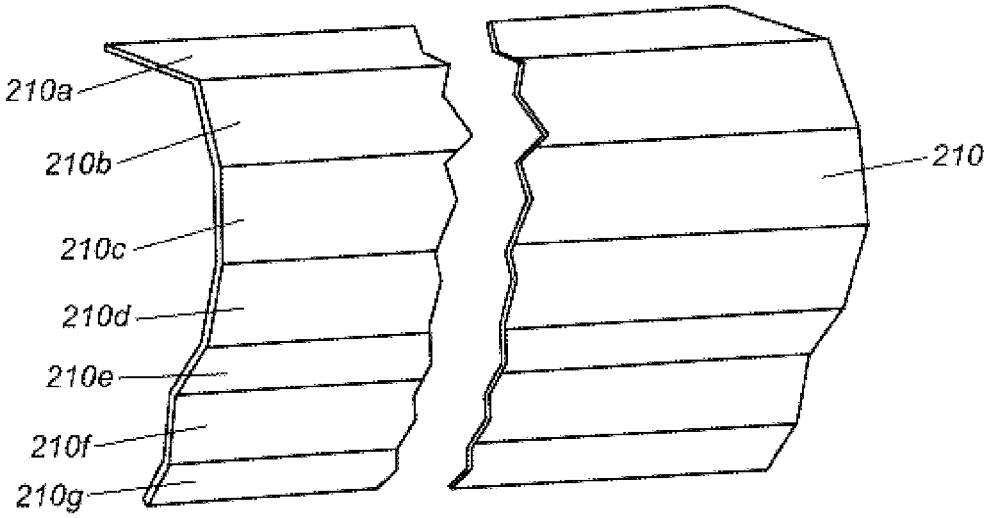
FIG. 6A is a perspective view of a front wall member of the rolling window screen apparatus of FIG. 1.
Figure 6B:
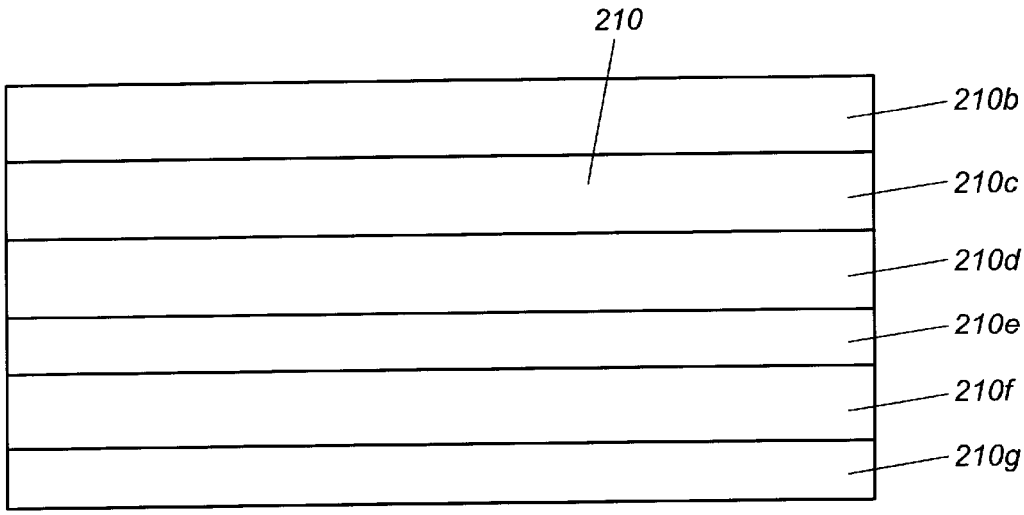
FIG. 6B is a front view of a front wall member of the rolling window screen apparatus of FIG. 1.
Figure 6C:
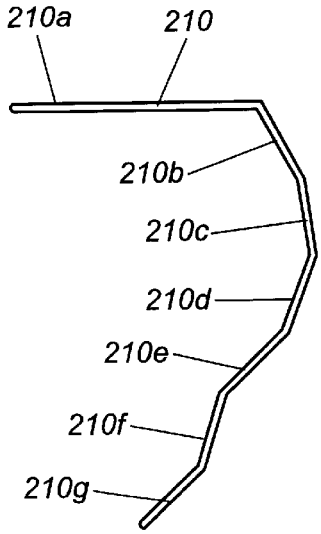
FIG. 6C is a side view of one end of a front wall member of the rolling window screen apparatus of FIG. 1.
Figure 6D:
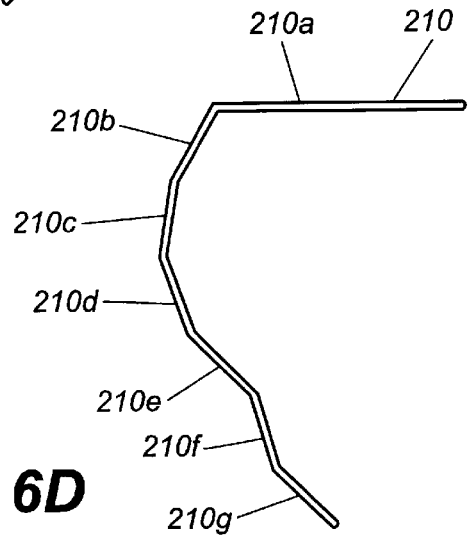
FIG. 6D is a side view of the opposite end of the front wall member of the rolling window screen apparatus of FIG. 6C.
Figure 6E:
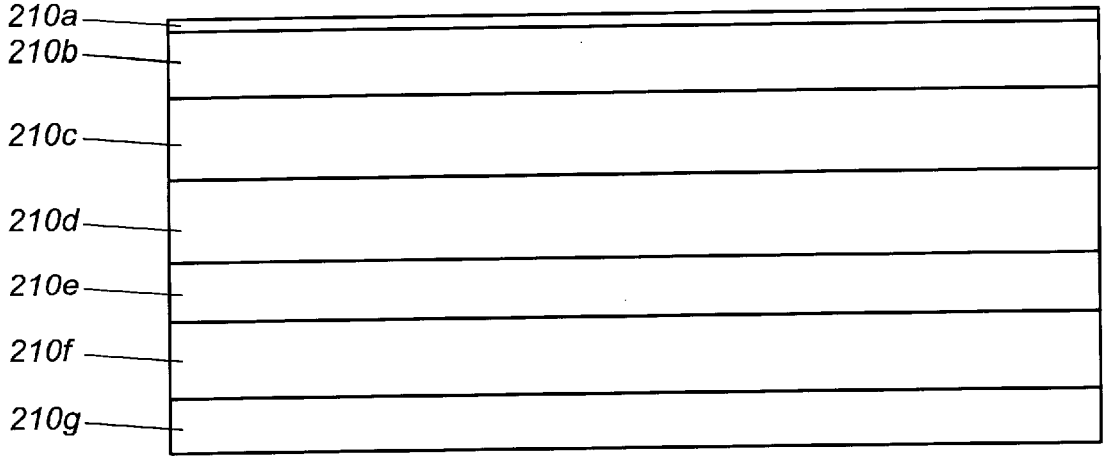
FIG. 6E is a back view of a front wall member of the rolling window screen apparatus of FIG. 1.
Figure 6F:
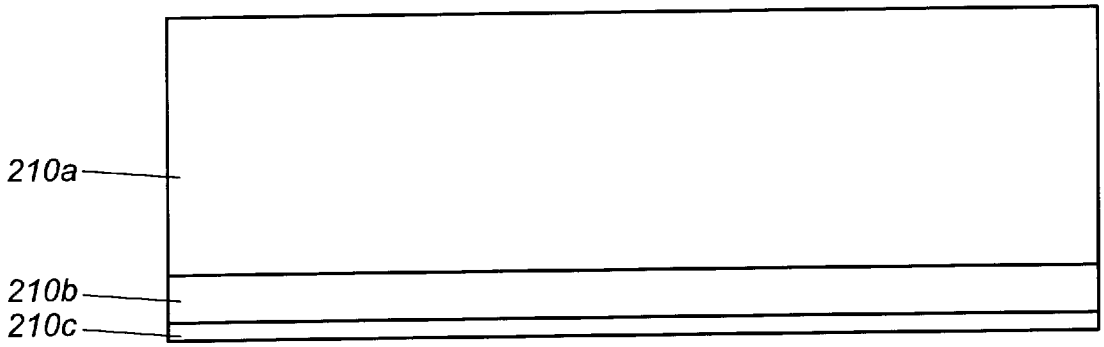
FIG. 6F is a top view of a front wall member of the rolling window screen apparatus of FIG. 1.
Figure 6G:
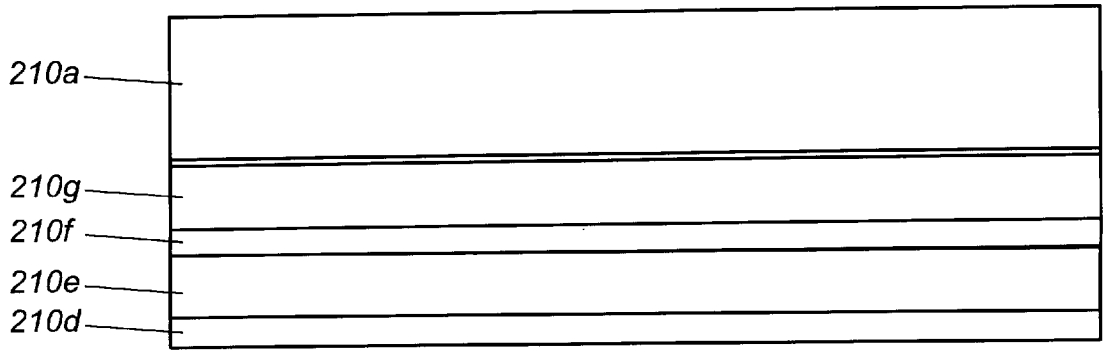
FIG. 6G is a bottom view of a front wall member of the rolling window screen apparatus of FIG. 1.

As best shown in FIGS. 2 and 5, the rolling window screen assembly 5 comprises a take-up roller 40 rotatably attached between the window frame sides 30, 35 substantially near the top of the window frame 15. A flexible screen 45 having a first end and a second end is connected at the first end to the roller 40. Preferably, the flexible screen is a window screen manufactured from plastic-coated fiberglass filaments woven together to form a mesh. The flexible screen 45 may be unwound and wound, as desired, about the roller 40. The roller 40 includes a conventional roller retractor which comprises a bias which preferably is an internal, spring-tensioned retractor mechanism 215. The bias is capable of applying continuous tension to the flexible screen 45 while also permitting the flexible screen 45 to be withdrawn against the spring force and wrapped again. The retractor mechanism 215 also provides sufficient spring force to keep the flexible screen 45 taut when unwound.

Preferably, the roller 40 is mounted within a housing 185 by means of pins 190, 195. The housing 185 comprises a first end cap member 200, a second end cap member 205 and a front wall member 210. The pins 190, 195 are held in place in recesses in first and second end cap members 200, 205, respectively. Each end cap member 200, 205 further comprises a mounting hole 220 in which a bushing 225 is inserted. The housing 185 may be securely mounted to the window frame sides 30, 35 by inserting a wood screw 230 through the bushing 225 in each end cap member 200, 205 and into the respective window frame side 30, 35.

As best shown in FIGS. 1 and 6A–6G, the front wall member 210 covers take up roller 40 and housing 185. Front wall member 210 includes a series of horizontal slats which are positioned at various angles to provide shadowing to create an appearance which suggests that window screen assembly 5 is absent from the window assembly. A front wall top member 210*a* is located substantially adjacent the lower surface of the top of the window frame 15. First slat member 210*b* depends downward from front wall top member 210*a* generally at an angle of one hundred and seventeen degrees. Second slat member 210*c* depends downward from first slat member 210*b* at an angle generally equal to one hundred and sixty-three degrees. Third slat member 210*d* depends downward from second slat member 210*c* at a general angle of one hundred and forty-eight degrees. Fourth slat member 210*e* depends downward from fourth slat member 210*d* and a general angle of one hundred and fifty-five degrees. Fifth slat member 210*f* depends downward from fourth slat member 210*e* at a general angle of two hundred and nine degrees. Sixth slat member 210*g* depends downward from fifth slat member 210*f* at a general angle of one hundred and forty-eight degrees. The overall construction of front wall member 210 creates shadowing on the respective horizontal slats in a manner replicating the shadowing of the top of window frame 15 and upper window sash 20 which would exist in the absence of window screen assembly 5. Hence, this aids in creating the optical illusion that window screen assembly 5 is not present.

Figure 7:
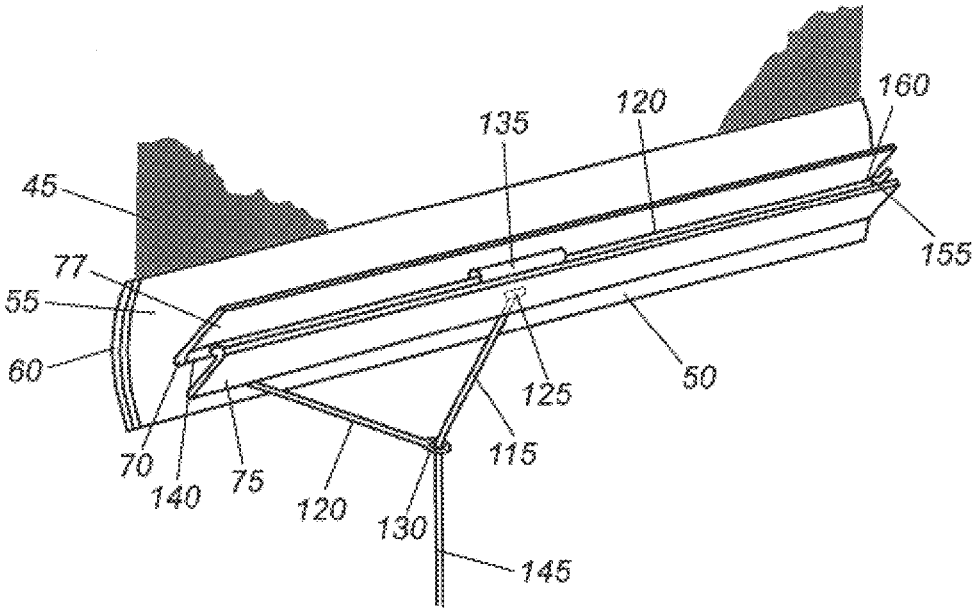
FIG. 7 is a detailed perspective view of a pull-down bar of the rolling window screen apparatus in accordance with the preferred embodiments of the present invention.

As shown in FIGS. 4 and 7, a resilient pull-down bar 50 is connected to the second end of the flexible screen 45. Preferably, as shown in FIGS. 5 and 7, the pull-down bar 50 comprises a pair of elongated planar members 55, 60 and a first automatic deployment interface 65. The elongated planar members 55, 60 are secured on either side of an edge of the flexible screen 45. The first automatic deployment interface 65 is affixed to a first elongated planar member 55 which protrudes from the first elongated planar member 55 substantially between the ends of the elongated planar members 55, 60. The first automatic deployment interface 65 is comprised of a first portion 70, a second portion 75, and a third portion 77. The first portion 70 of the first automatic deployment interface 65 extends from the first elongated planar member 55 in a generally rearward direction toward the upper window sash 20 to connect to the second portion 75 at a vertex. The second portion 75 extends from the vertex in a generally downward direction toward the sill 17. The third portion 77 extends from the first elongated planar member 55 in a generally upward direction toward the roller 40.

Figure 8:
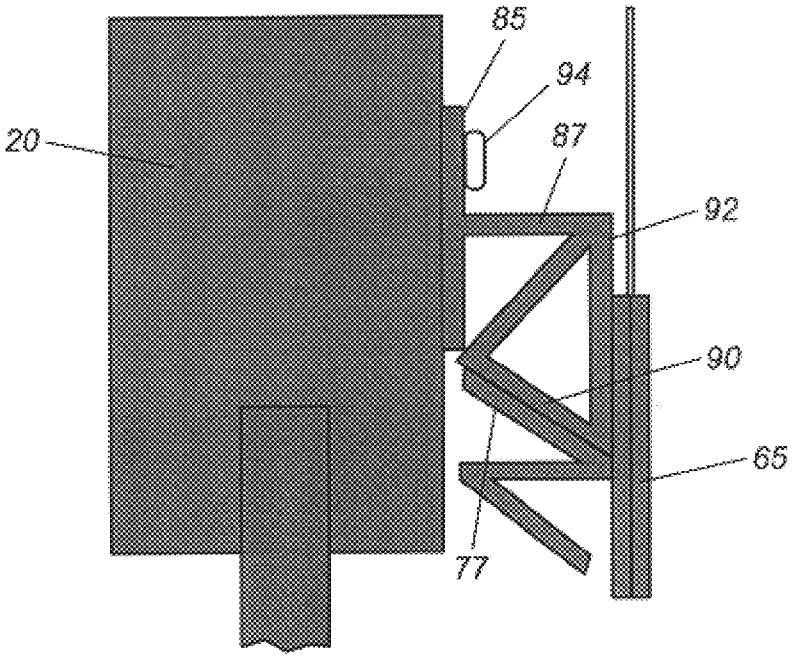
FIG. 8 is a cross-sectional view of the first automatic deployment interface and the retention deployment interface of the rolling window screen apparatus of FIG. 3.

As shown in FIGS. 3 and 8, the rolling window screen assembly 5 also comprises a retention deployment interface 80 mounted, generally, across and protruding from the uppermost segment of the upper window sash 20 at a location which enables it to cooperate with the first automatic deployment interface 65. The retention deployment interface 80 comprises an elongated mounting flange 85, a first interface portion 87, a second interface portion 90 and a third interface portion 92. The elongated mounting flange 85 may be secured to the upper window sash 20 using a plurality of wood screws 94. The first interface portion 87 extends from the elongated mounting flange 85 in a generally forward direction away from the upper window sash 20. The second interface portion 90 extends from the elongated mounting flange 85 in a, generally, downward direction. Preferably, the third interface portion extends generally vertically from an outer edge of the first interface portion 87 to an outer edge of the second interface portion 90. The third portion 77 of the first automatic deployment interface 65 and the second and third interface portions 90, 92 of the retention deployment interface 80 are sized so that the second and third interface portions 90, 92 of the retention deployment interface 80 may be manually placed in a position between the third portion 77 of the first automatic deployment interface 65 and the remainder of the pull-down bar 50. Once the first automatic deployment interface 65 is thus engaged by the retention deployment interface 80, upward movement of the pull-down bar 50 is thus prevented by the force of the retention deployment interface 80.

Figure 9:
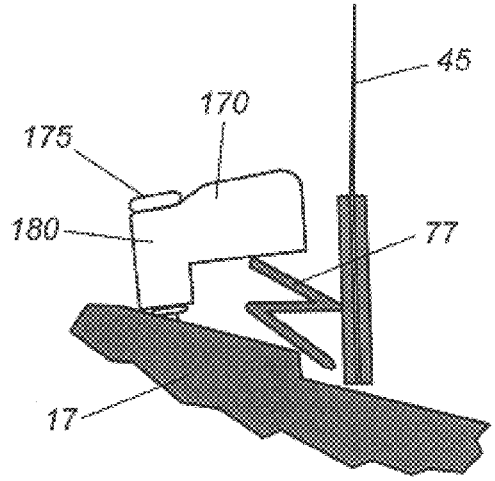
FIG. 9 is a cross-sectional view of the first automatic deployment interface and retention members of the rolling window screen apparatus of FIG. 2.

As shown in FIG. 2, the rolling window screen assembly 5 further comprises a pair of retention members 170 which are mountable to the sill 17 of the window frame 15. As best shown in FIG. 9, each retention member includes a screw 175 rotatably inserted through a retention bracket 180 and secured into the sill 17. The retention brackets 180 may be rotated to a position suitable for engaging an upper surface of the third portion 77 of the first automatic deployment interface 65. When engaged, the retention members 170 prevent the flexible screen 45 from being retracted.

Referring again to FIG. 9, an additional feature of the effect of the retention members 170 on the first automatic deployment interface 65 is next shown and described. The force of the retention brackets 180 on the upper surface of the third portion 77 of the first automatic deployment interface 65 axially biases the upper portions of the pull-down bar 50 toward the retention members 170. Similarly, the lower surface of the second portion 75 of the first automatic deployment interface 65 is axially biased downward, thus bringing the second portion 75 into contact with the sill 17. The contact between the second portion 75 and the sill 17, and between the bottom of the elongated planar members 55, 60 and the sill 17, prevents insects and the like from going around the flexible screen 45 to gain entry into a building.

Figure 10:
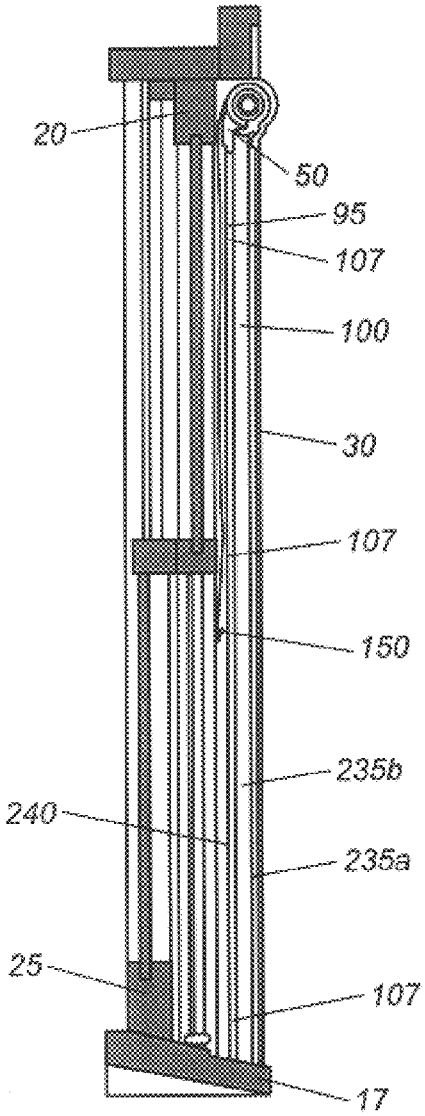
FIG. 10 is a cross-sectional view of the rolling window screen apparatus and window of FIG. 1 as viewed from a side.
Figure 10A:
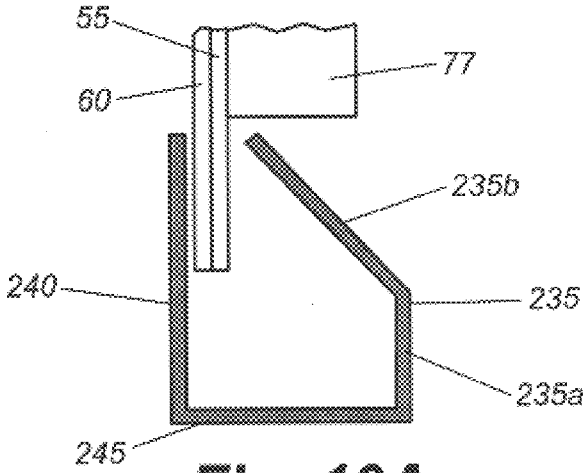
FIG. 10A is a detailed cross-sectional view of a side channel of the rolling window screen apparatus of FIG. 1 as viewed from above.
Figure 12:
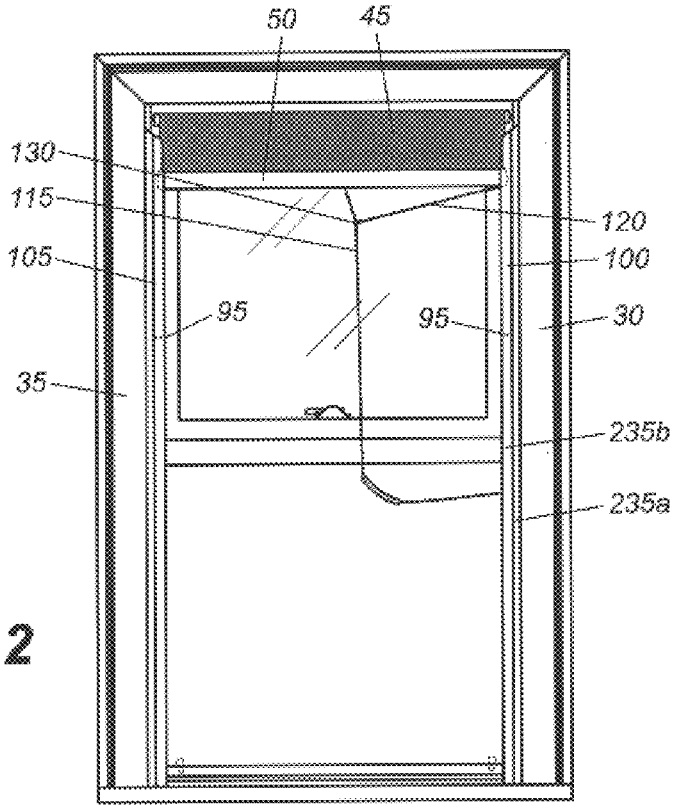
FIG. 12 is a front view of the rolling window screen apparatus of FIG. 4 in which the pull-cord apparatus is fully tensioned and the screen is partially deployed

As shown in FIGS. 10, 10A and 12, the ends of the pull-down bar 50 and the side edges of the flexible screen 45 arc slideably inserted into vertical slots 95 defined by side channels 100, 105. The side channels 100, 105 are affixed to the window frame sides 30, 35 and extend for substantially the height of the window frame. Preferably, the side channels 100, 105 may be mounted to the window frame sides 30, 35 using a fastener 107, which preferably may be a wood screw. Each side channel comprises a front channel member 235, a rear channel member 240, and a channel mounting member 245.

As best shown in FIG. 10A, each front channel member 235 includes a series of generally vertical slats which are positioned at various angles to provide shadowing to create an appearance which suggests that window screen assembly 5 is absent from the window assembly. First front channel slat member 235*a* is located substantially parallel to the upper and lower window sashes 20, 25. Second front channel slat member 235*b* depends from first front channel slat member 235*a* toward the window sashes generally at an angle of one hundred and fifty degrees. The overall construction of front channel member 235 creates shadowing on the respective vertical slats in a manner replicating the shadowing of the side of window frame 15 and upper and lower window sashes 20, 25 which would exist in the absence of window screen assembly 5. Hence, the overall construction of the front channel member 235, along with that of the front wall member 210, creates the optical illusion that window screen assembly 5 is not present.

Referring again to FIGS. 5 and 8, an additional feature of the first automatic deployment interface 65 relative to the retention deployment interface 80 is next shown and described.

As shown in FIG. 7, the rolling window screen assembly 5 also comprises a pull-cord apparatus 110 for effecting movement of the flexible screen. The pull-cord apparatus 110 includes the pull-down bar 50 and a pair of cords 115, 120. A first, non-elastic pull-cord 115 depends from the pull-down bar 50 through an aperture 125 in its bottom surface. The aperture 125 is centrally located between the ends of the pull-down bar 50. A first end of the pull-cord 115 is secured to a short length of tubing 135 for a purpose to be explained below. The short length of tubing 135 is located generally inside the pull-down bar 50. As shown in FIGS. 4 and 7, the remainder of the pull-cord 115, including a force transmitting portion 145 of the pull-cord 115 and a second end of pull-cord 115, resides substantially adjacent the outer side of the window sashes 20, 25.

A second, elastic take-up cord 120 has a first end secured internally to one end of the pull-down bar 50. The first end of the elastic take-up cord 120 may be easily retained by inserting the first end through a slit 155 in the end of the pull-down bar and tying a knot 160 near the first end of the elastic take-up cord 120. The knot 160 and the slit 155 are preferably sized so that the knot 160 cannot travel through the slit 155. The remainder of the elastic take-up cord 120 is guided from within the pull-down bar 50 through the short length of tubing to the second, opposite end of the pull-down bar 50 and through an opening 140 to depend from the second end of the pull-down bar 50. Preferably, the opening 140 is comprised of a first eyelet. The second end of the elastic take-up cord 120 connects to a second eyelet 130 outside the pull-down bar 50. The opening 140 and the eyelet 130 are preferably sized so that the second eyelet 130 cannot travel through the opening 140. The pull-cord 115 extends through the second eyelet 130 such that the force transmitting portion 145 of the pull-cord 115 depends from the second eyelet 130.

Figure 11:
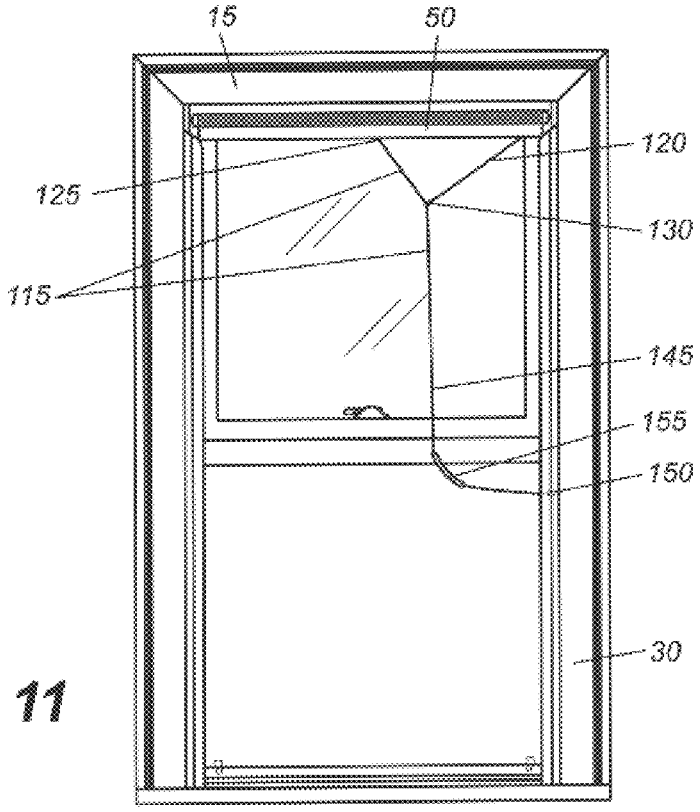
FIG. 11 is a front view of the rolling window screen apparatus of FIG. 4 in which the pull-cord apparatus is partially tensioned.

As shown in FIG. 4, the elastic property of the elastic take-up cord 120 causes the second end of the elastic take-up cord 120 to be normally pulled toward the first eyelet 140, and, hence, causes the second eyelet 130 to be normally positioned adjacent the first eyelet 140, thereby guiding the pull-cord 115 first in a direction parallel to the axial direction of the take-up roller 40 and then allowing the pull-cord 115 to depend, in an aesthetically-pleasing manner, adjacent a side 30 of the window frame 15. However, when a generally downward force is exerted on the pull-cord 115, a corresponding force is exerted on the eyelet 130 connected to the elastic take-up cord 120. As shown in FIGS. 11 and 12, the elastic property of the elastic take-up cord 120 allows the elastic take-up cord 120 to stretch when the corresponding force is exerted upon the eyelet 130. As the elastic take-up cord 120 is stretched, it moves through the short length of tubing 135 and through the first eyelet 140. Preferably, the first eyelet 140 is comprised of a material creating a relatively low amount of friction on the elastic take-up cord 120 as the elastic take-up cord 120 is moved through it. Similarly, the short length of tubing 135 protects the elastic take-up cord 120 from additional friction created by contact with the pull-cord 115 near the centrally located aperture 125 in the pull-down bar 50. The elastic take-up cord 120 is stretched until the eyelet 130 becomes repositioned beneath the pull-down bar as shown in FIG. 12 in a location generally central to the pull-down bar 50, thereby enabling the downward force to be applied centrally to the pull-down bar 50. Upon the removal of the downward force, the elastic nature of the elastic take-up cord 120 causes the elastic take-up cord 120 to contract until the second eyelet 130 becomes, once again, positioned adjacent the first eyelet 140. This allows the pull-cord 115 to depend, once again, adjacent a side 30 of the window frame 15, as shown in FIG. 4.

As shown in FIG. 11, preferably, the second end of the first cord 115 is connected to a third eyelet 150 which may be secured to the window frame side 30 using a wood screw. The third eyelet 150 is attached at a location on the window frame side 30 generally midway between the top and bottom of the side 30. The location at which the third eyelet 150 is attached is chosen to be substantially adjacent the location of the second end of the pull-cord 115 when no downward force is being exerted on the pull-cord 115 so that the second eyelet 130 is free to maintain its position adjacent the first eyelet 140. In addition, the pull-cord apparatus 110 preferably further comprises a handle 155 slideably connected to the force transmitting portion 145 of the pull-cord 115. The handle 155 preferably comprises a plastic tube of such a size that it may be grasped easily. Together, the attachment of the second end of the first cord 115 and the handle 155 provide a means for more conveniently exerting the generally downward force previously described. When a force is exerted on the handle 155 which has a component which is generally downward and a component which is generally lateral from the attachment side 30 of the window frame 15 toward the opposite side 35, the handle 155 begins to slide from the second end of the pull-cord 115 toward the first end of the pull-cord 115 as shown in FIG. 11. As the handle moves away from the window frame side 30 and becomes repositioned underneath a central location of the pull-down bar 50, the generally downward component of the force allows the elastic take-up cord 120 to stretch and move as described previously and as shown in FIG. 12.

In operation, the flexible screen 45 may be selectively deployed and retracted to cover all or part of a window in order to prevent objects from passing through an open window. The general operation of the flexible screen 45 is as follows. As shown in FIGS. 2, 3 and 4, the spring force exerted by the retractor mechanism 215 on the roller 40 continuously urges the flexible screen 45 into a substantially retracted position in which the flexible screen 45 is substantially fully wound around the roller 40 and statically held in place. As described previously, in the substantially fully retracted position, the second eyelet 130 of the elastic take-up cord 120 is thus pulled toward the second end of the pull-down bar. In the substantially fully retracted position, the second end of the pull-down bar 50 is substantially adjacent an upper corner of the window frame 15. Thus, the first cord is guided from a location generally central to the pull-down bar toward the upper corner and then to depend adjacent the window frame side 30. However, when a generally downward force is exerted on the force transmitting portion 145 of the first cord 115 or, preferably, on the handle slideably connected to the force transmitting portion 145 of the first cord 115, a corresponding force is exerted on the eyelet 130 connected to the elastic take-up cord 120. The elastic property of the elastic take-up cord 120 allows the elastic take-up cord 120 to stretch, as shown in FIG. 11, until the second eyelet 130 becomes repositioned beneath a location generally central to the pull-down bar 50, thereby enabling the downward force to be applied centrally to the pull-down bar 50. The continued application of the generally downward force causes the flexible screen 45 to begin to unwind from the roller 40, as shown in FIG. 12. As the flexible screen 45 is moved downward, the side channels 100, 105 guide the pull-down bar 50 and the flexible screen 45 in the vertical slots 95, thereby limiting movement of the screen 45 to a substantially vertical direction and promoting smooth operation. The positioning of the pull-cord apparatus enables a user located within a dwelling to deploy the flexible screen from inside the dwelling.

Once the generally downward force on the pull-down bar is removed, the operation of the flexible screen 45 is reversed and the flexible screen 45 is retracted. The flexible screen 45 is wound onto the roller 40. The side channels 100, 105 guide the smooth upward movement of the pull-down bar 50 and the edges of the flexible screen 45 within the vertical slots 95 until the screen returns to the substantially fully retracted position once more.

At any given time the flexible screen 45 may be engaged, under the above generally described method of operation, in one of at least three engagement states. In a first engagement state, shown in FIG. 2, the flexible screen 45 is statically deployed using the operation generally described previously. The generally downward force is applied to the pull down bar 50 until the pull down bar 50 is substantially adjacent to the sill 17. The retention members 170 may then be adjusted to engage the pull-down bar by abutting the upper surface of the third portion 77 of the first automatic deployment interface 65, as shown in FIG. 9. The tension imposed on the flexible screen 45 by the retractor mechanism 215 is resisted by the downward force imposed by the retention members 170 to statically deploy the flexible screen 45 to cover the entire window. It should be clear that although, as described, the flexible screen is deployed to cover substantially the entire window, retention members 170 may alternatively be placed in other locations in the vertical direction to enable alternative static deployments of the screen 45. Thus, the user located within the dwelling may deploy the flexible screen from inside the dwelling.

In a second engagement state, shown in FIG. 3, the flexible screen 45 is dynamically deployed using the operation generally described previously. However, the generally downward force is applied to the pull down bar 50 by engaging the pull down bar 50 to the retention deployment interface 80 as shown in FIG. 8 and applying the generally downward force to the upper window sash 20. As the upper window sash 20 is slid downward between the window frame sides 30, 35, the retention deployment interface 80 secured to the upper window sash 20 is moved as well. The second and third portions 75, 77 of the retention deployment interface 80 engage the first portion 70 of the first automatic deployment interface 65 and retained against the remainder of the pull down bar 50. This engagement thus exerts a generally downward force on the pull down bar 50 and the flexible screen 45 is thus deployed as described previously. The tension imposed on the flexible screen 45 by the retractor mechanism 215 is resisted by the downward force imposed by the retention deployment interface 80. In the second engagement state, however, the extent to which the flexible screen 45 is deployed depends on the position in which the upper window sash 20 is placed by a user. Thus, in the second engagement state, the flexible screen 45 is deployed dynamically according to the position of the upper window sash 20. Once again, the user may deploy the flexible screen from inside the dwelling by merely positioning the upper sash.

In a third engagement state, shown in FIG. 4, the retention deployment interface 80 is disengaged from the first automatic deployment interface 65 and no generally downward force is applied to the pull down bar 50, thus allowing the flexible screen to substantially fully retract onto the roller. In this engagement state, the movement of the upper window sash 20 does not affect the deployment of the flexible screen 45, as best shown in cross-section in FIG. 12, and the substantially full retraction of the flexible screen 45 enables substantially all of the window to be exposed.

In an additional feature of the present invention, the pull-down bar 60 and the flexible screen 45 may be easily adjusted from one engagement state to another. To adjust the flexible screen 45 from the first engagement state to the second engagement state, the retention members 170 are first manipulated to achieve the release of the first automatic deployment interface 65 from the retention brackets 180. As previously described, the tension imposed by the retractor mechanism 215 causes the flexible screen 45 to be gradually wound onto the roller 40 The side channels 100, 105 guide the smooth upward movement of the pull-down bar 50 and the edges of the flexible screen 45 within the vertical slots 95 until the third portion 77 of the first automatic deployment interface 65 is engaged by the retention deployment interface 80 in the second engagement state. The steps just described may be reversed to adjust the flexible screen 45 from the second engagement state to the first engagement state.

To adjust the flexible screen from the second engagement state to the third engagement state, the first automatic deployment interface 65 is first disengaged from the retention deployment interface 80 by moving the pull-down bar downward until the pull-down bar 50 is generally no longer adjacent to the retention deployment interface 80. The pull-down bar 50 may then be manipulated to laterally displace the first automatic deployment interface 65, in a direction generally away from the window sashes 20, 25.

The lateral displacement must be of a sufficient distance to allow the first automatic deployment interface 65 to be successfully moved upward without significant interference from the retention deployment interface 80. It is a feature of the present invention that sufficient lateral displacement may be achieved by removing the pull-down bar 50 and flexible screen 45 from the vertical slots 95 or by flexing the resilient pull-down bar 50 without removing the bar from the slots. Similarly, the flexible screen may be adjusted from the first engagement state to the third engagement state by first manipulating the retention members 170 to achieve the release of the first automatic deployment interface 65 from the retention brackets 180 and then following the procedure just described.

To adjust the flexible screen from the third engagement state to the second engagement state or to the first engagement state, a centrally-located generally downward force is exerted upon the pull-down bar 50 to move the pull-down bar 50 downwardly until the lower surface of the second portion 75 of the first automatic deployment interface 65 is makes contact with the first interface portion 87 of the retention deployment interface 80. It is an additional feature of the present invention that the slope of the lower surface of the second portion 75 of the first automatic deployment interface 65 effectuates the outward movement of the first automatic deployment interface 65 when sufficient downward force is exerted upon the pull-down bar 50. The lateral displacement created by this action, in combination with the flex created in the resilient pull-down bar, is sufficient to allow the first automatic deployment interface 65 to be moved downard past the retention deployment interface 80 while the pull-down bar is still being retained within the vertical slots 95 by the side channels 100, 105. The pull-down bar 50 may then be manipulated to engage the first automatic deployment interface within the retention deployment interface 80 to achieve the second engagement state, or the pull-down bar 50 may then be lowered to enable the retention members 170 to be manipulated to engage the first automatic deployment interface 65 to achieve the first engagement state.

Although the pull-down bar 50 and pull-cord apparatus 110 are depicted only as being operable with the flexible window screen 45 described previously, it should be clear that they may similarly be used with shades and other window treatments, and that such use is within the scope of the present invention.

While the embodiments of the present invention which have been disclosed herein are the preferred forms, other embodiments of the method and apparatus of the present invention will suggest themselves to persons skilled in the art in view of this disclosure. Therefore, it will be understood that variations and modifications can be effected within the spirit and scope of the invention and that the scope of the present invention should only be limited by the claims below.

We claim:

1. A rolling window screen apparatus comprising:

a roller rotatably attachable to a window assembly, wherein said window assembly includes a window frame having top, bottom, and opposite sides which together define a window area and having a sash slideably retained within the window frame for being selectively positioned for defining a window opening within the window frame; and a flexible screen carried by the roller, wherein the flexible screen may be deployed in at least three deployment states, and wherein the at least three deployment states comprise:

a first deployment state wherein the flexible screen is releasably engaged to the window frame to enable the flexible screen to be deployed statically to cover at least a portion of the window opening;

a second deployment state wherein the flexible screen is releasably engaged to the sash to enable the flexible screen to be deployed dynamically according to the position of the sash; and a third deployment state wherein the flexible screen is disengaged from the window assembly to enable the retraction of the flexible screen onto the roller to expose substantially all of the window opening.

2. The rolling window screen apparatus of claim 1 further including a pull-down bar carried by the flexible screen for facilitating the deployment of the flexible screen.

3. The rolling window screen apparatus of claim 2 further including vertical channels carried by the sides of the window frame for guiding the movement of the flexible screen while the screen is being positioned, the pull-down bar being slideably positioned within the vertical channels.

4. The rolling window screen apparatus of claim 2 wherein the pull-down bar includes a first automatic deployment interface, and wherein the rolling window screen apparatus further includes a retention deployment interface attached to the sash for releasably engaging the first automatic deployment interface and for facilitating in the positioning of the flexible screen in the second deployment state.

5. The rolling window screen apparatus of claim 4 including a biasing member for biasing the roller in a predetermined direction that biases the pull-down bar upward, thereby causing the retention deployment interface to engage the first automatic deployment interface wherein movement of the sash is transmitted to the flexible screen.

6. The rolling window screen apparatus of claim 4 wherein the first automatic deployment interface includes a bottom inclined member and the retention deployment interface includes a top inclined member for being positioned against the bottom inclined member of the first automatic deployment interface.

7. The rolling window screen apparatus of claim 2 wherein the rolling window screen apparatus further includes a retaining bracket attached to the bottom of the window frame, and wherein the pull-down bar includes a retention deployment interface for engaging the retaining bracket and for facilitating in the positioning of the flexible screen in the first deployment state.

8. A pull-cord apparatus for deploying a window treatment, the pull-cord apparatus comprising:

a pull-down non-elastic cord having a general length attached to a window treatment having a bottom and a bottom edge, wherein the window treatment is rollable into an undeployed position and unrollable into a deployed position for at least partially covering a window, wherein the pull-down non-elastic cord attaches substantially near the center of the bottom;

an elastic take-up cord of a general length carried by the bottom edge of the window treatment;

an interface for interfacing the pull-down non-elastic cord and the elastic take-up cord at a position below the bottom of the window treatment enabling the elastic take-up cord to influence the pull-down non-elastic cord;

a stiffening member carried by the bottom of the window treatment intermediary to the pull-down non-elastic cord and the elastic take-up cord;

wherein the pull-down non-elastic cord has a first retracted position wherein the elastic take-up cord influences a portion of the pull-down non-elastic cord to be generally horizontal to the bottom of the window treatment, the pull-down non-elastic cord having a sufficient length such that a force transmitting portion of the pull-down non-elastic cord depends downward from the interface providing a surface for grabbing when in the first retracted position; and wherein the pull-down non-elastic cord has a second position when a downward force is applied to the force transmitting portion of the pull-down non-elastic cord such that the pull-down non-elastic cord is generally normal to the bottom of the window treatment enabling the downward force to be transmitted to the window treatment facilitating the downward deployment of the window treatment.

9. The pull-cord apparatus of claim 8 wherein the elastic take-up cord is of a sufficient length to approximately extend to the center of the bottom of the window treatment enabling the pull-down non-elastic cord to become generally normal when a downward force is applied to the force transmitting portion of the pull-down non-elastic cord.

10. The pull-cord apparatus of claim 8 wherein the window resides in a window frame having a sidewall with a length, and wherein the pull-down non-elastic cord has a sufficient length to extend from the center of the bottom of the window treatment to the bottom edge of the window treatment for interfacing with the elastic cord and for continuing generally along the length of the sidewall of the window frame.

11. The pull-cord apparatus of claim 10 including a handle slideably carried by the pull-down non-elastic cord for transmitting a downward force onto the pull-down non-elastic cord, the handle sliding along the length of the pull-down non-elastic cord when a downward force is applied thereto.

12. A rolling window screen apparatus comprising:

a roller rotatably attachable to a window assembly, wherein said window assembly includes a window frame having top, bottom, and opposite sides which together define a window area and having a sash slideably retained within the window frame for being selectively positioned for defining a window opening within the window frame; and a flexible screen carried by the roller and having an edge, wherein the flexible screen is deployable in at least three deployment states, and wherein the at least three deployment states comprise:

a first deployment state wherein the flexible screen is releasably engaged to the window frame to enable the flexible screen to be deployed statically to cover at least a portion of the window opening;

a second deployment state wherein the flexible screen is releasably engaged to the sash to enable the flexible screen to be deployed dynamically according to the position of the sash; and a third deployment state wherein the flexible screen is disengaged from the window assembly to enable the retraction of the flexible screen onto the roller to expose substantially all of the window opening; and a pull-cord apparatus for deploying the flexible screen, the pull-cord apparatus comprising:

a pull-down non-elastic cord having a general length connected to the edge of the flexible screen;

an elastic take-up cord of a general length carried by the edge of the flexible screen;

an interface for interfacing the pull-down non-elastic cord and the elastic take-up cord at a position below the edge of the flexible screen enabling the elastic take-up cord to influence the pull-down non-elastic cord;

wherein the pull-down non-elastic cord has a first retracted position wherein the elastic take-up cord influences a portion of the pull-down non-elastic cord to be generally horizontal to the edge of the flexible screen, the pull-down non-elastic cord having a sufficient length such that a force transmitting portion of the pull-down non-elastic cord depends downward from the interface providing a surface for grabbing when in the first retracted position; and wherein the pull-down non-elastic cord has a second position when a downward force is applied to the force transmitting portion of the pull-down non-elastic cord such that the pull-down non-elastic cord is generally normal to the edge of the flexible screen enabling the downward force to be transmitted to the flexible screen facilitating the downward deployment of the flexible screen.

13. The rolling window screen apparatus of claim 12 further including a pull-down bar carried by the flexible screen for facilitating the deployment of the flexible screen.

14. The rolling window screen apparatus of claim 13 further including vertical channels carried by the sides of the window frame for guiding the movement of the flexible screen while the screen is being positioned, the pull-down bar being slideably positioned within the vertical channels.

15. The rolling window screen apparatus of claim 13 wherein the pull-down bar includes a first automatic deployment interface, and wherein the rolling window screen apparatus further includes a retention deployment interface attached to the sash for releasably engaging the first automatic deployment interface and for facilitating in the positioning of the flexible screen in the second deployment state.

* * * * *